US011139578B1

(12) United States Patent
Hu

(10) Patent No.: US 11,139,578 B1
(45) Date of Patent: Oct. 5, 2021

(54) ELECTRICALLY-CONTROLLED SWITCHING MULTI-POLARIZATION HORN ANTENNA

(71) Applicant: Nan Hu, Beijing (CN)

(72) Inventor: Nan Hu, Beijing (CN)

(73) Assignee: Nan Hu, Beijing (CN)

( * ) Notice: Subject to any disclaimer, the term of this patent is extended or adjusted under 35 U.S.C. 154(b) by 0 days.

(21) Appl. No.: 17/331,658

(22) Filed: May 27, 2021

Related U.S. Application Data

(63) Continuation of application No. PCT/CN2019/088111, filed on May 23, 2019.

(51) Int. Cl.
*H01Q 13/02* (2006.01)
*H01Q 1/36* (2006.01)
*H01Q 5/28* (2015.01)

(52) U.S. Cl.
CPC ..... *H01Q 13/0275* (2013.01); *H01Q 1/36* (2013.01); *H01Q 5/28* (2015.01); *H01Q 13/025* (2013.01); *H01Q 13/0241* (2013.01)

(58) Field of Classification Search
CPC .. H01Q 13/02; H01Q 13/0241; H01Q 13/025; H01Q 13/0275; H01Q 5/28; H01Q 1/36
See application file for complete search history.

(56) References Cited

U.S. PATENT DOCUMENTS 4,965,868 A * 10/1990 Wong ..... H01P 1/16 333/117

FOREIGN PATENT DOCUMENTS

| | | | | |
|---|---|---|---|---|
| CN | 2294527 Y | | 10/1998 | |
| CN | 106299664 A | | 1/2017 | |
| CN | 107069189 A | | 8/2017 | |
| CN | 207743390 U | | 8/2018 | |
| CN | 108777369 A | | 11/2018 | |
| WO | WO-2012119898 A1 | * | 9/2012 | ..... H01P 1/17 |

* cited by examiner

*Primary Examiner* — Hoang V Nguyen
(74) *Attorney, Agent, or Firm* — Gang Yu

(57) ABSTRACT

The present invent discloses an electrically-controlled switching multi-polarization horn antenna, which relates to the technical field of communication antennas. The horn antenna includes a horn antenna body, a polarization controller and a polarization switching apparatus. The horn antenna's control module controls a linear polarization control generation module, a circular polarization control generation module and a polarization selection module to cause the horn antenna to operate in a horizontal polarization mode, a vertical polarization mode, a left-hand circular polarization mode or a right-hand circular polarization mode. The antenna can realize a quick switch between different polarization modes, and the switch is electrically controlled rather than performed by manually replacing the antenna. Using the antenna of the present invent can effectively shorten test time, reduce the number of times replacing antennas by a tester, and more accurately measure characteristics of a device under test in various polarization modes.

6 Claims, 3 Drawing Sheets

ELECTRICALLY-CONTROLLED SWITCHING MULTI-POLARIZATION HORN ANTENNA

TECHNICAL FIELD

The present invent relates to the technical field of communication antennas, and in particular, to an electronically controlled switching multi-polarization horn antenna.

BACKGROUND

An antenna is a kind of electromagnetic field energy converter which converts a guided wave propagating on a transmission line into an electromagnetic wave propagating in an unbounded medium (usually the free space), or performs reverse conversion. The antenna is a core component for transmitting or receiving electromagnetic waves in radio equipments. Engineering systems such as radio communication, broadcast, television, radar, navigation, electronic countermeasures, remote sensing, and radio astronomy, that use electromagnetic waves to transmit information all need to rely on an antenna to work. In addition, non-signal energy radiation also requires the antenna.

The electric field direction and the magnetic field direction of the electromagnetic wave emitted by an antenna are perpendicular to each other. The polarization direction of the antenna is defined by the electric field direction. If the electric field direction is perpendicular to the ground (the magnetic field must be horizontal to the ground), the electromagnetic wave is called as a vertical polarization wave, and otherwise, the electromagnetic wave is called as a horizontal polarization wave. Antenna installation direction must be the same as the polarization direction, otherwise signals cannot be received or the efficiency is very poor. The antenna of a radio is usually pulled out vertically, because the electromagnetic wave is a vertical polarization wave. The antenna of a television is typically mounted horizontally, because the electromagnetic wave is a horizontal polarization wave.

Antenna polarization is similar to optical polarization, which transmits and receives electromagnetic waves according to the orientation of the electromagnetic radiation. By optical polarization, a film or glass can block polarized light in a certain direction (i.e., become darker) and allow correctly polarized light to pass through. This is similar to an antenna—the polarization of the antenna determines of electromagnetic radiation transceiving performance.

The polarization is based on the oscillation plane of the electric field component of the electromagnetic radiation. If the polarization of the electromagnetic wave is not uniform with the polarization of the antenna, the antenna can only capture a portion of the electromagnetic energy.

Therefore, when the transmitting antenna and the receiving antenna take the same plane as the reference plane, their polarization directions should be the same in order to achieve the optimum efficiency of the communication link.

There are mainly three polarization types: linear polarization, circular polarization and elliptic polarization. The radio antenna is generally the linear polarization antenna or circular polarization antenna. The linear polarization antenna is generally a vertical polarization antenna or horizontal polarization antenna, and the circular polarization antenna is a left-hand circular polarization antenna or right-hand circular polarization antenna. In addition, a common polarization type is elliptic polarization formed by complex combination of linear polarization and circular polarization.

The polarization loss of a linear polarization system depends on the angle between a linear polarization antenna and a polarization vector of an electromagnetic wave, and the maximum polarization loss occurs when the angle is 45 degrees. At 45 degrees polarization vector deviation angle, the maximum polarization loss is 0.5 (i.e., 3 dB). In the case of the circular polarization system or elliptical polarization system, the calculation of the polarization loss is more complex. The maximum polarization loss can be as high as 30 dB. Although there is polarization loss, the antenna can still receive signals from electromagnetic waves with different polarization types. Therefore, there is a limit to the signal isolation that can be achieved by polarization.

Generally, an antenna polarization mode may be selected according to the application requirement. Different applications may achieve better results from different polarization modes. For example, since vertical polarization electromagnetic waves are more likely to penetrate uneven terrain than horizontal polarization electromagnetic waves, vertical polarization antennas perform better in use of land mobile communications. Horizontal polarization waves perform better in long-distance communications relying on ionized layers. In addition, circular polarization is often used for satellite communication because it generally better mitigates attenuation caused by satellite orientation drift.

It can be seen that in different application systems, antennas with different polarization modes are required to implement maximization of electromagnetic energy transmission and reception. Currently, several antennas with known polarization directions are used to perform measurement or receive an electromagnetic field signal. In the actual process, a tester needs to continuously replace test antennas, and different calibrations are required, which increases the test difficulty for the tester.

SUMMARY

The technical problem to be solved by the present invent is how to provide an electronically controlled switching multi-polarization horn antenna capable of rapidly realizing switching of polarization mode.

To solve the described technical problem, the present invent uses the following technical solution: an electrically-controlled switching multi-polarization horn antenna, including a horn antenna body, a polarization controller and a polarization switching apparatus, the polarization controller includes a linear polarization control generation module and a circular polarization control generation module, the signal output end of the horn antenna's control module is respectively connected with signal input ends of the linear polarization control generation module and the circular polarization control generation module, the linear polarization control generation module is used to generate a horizontal or vertical polarization control signal under control of the control module, and the circular polarization control generation module is used to generate a left-hand circular polarization or a right-hand circular polarization control signal under the control of the control module; the output ends of the linear polarization control generation module and the circular polarization control generation module are connected with an input end of a polarization selection module, the output end of the polarization selection module is connected with a control input end of the polarization switching apparatus on the horn antenna body, the polarization selection module is a polarization switching apparatus that used to select one of a horizontal polarization control signal, a vertical polarization control signal, a left-hand circular polarization control signal or a right-hand circular polarization control signal under the control of the control module; the polarization switching apparatus is configured to operate under the control of the control module and convert the received or transmitted signal, so as to make the horn antenna work in horizontal polarization mode, vertical polarization mode, left-hand circular polarization mode or right-hand circular polarization mode, a power supply module is connected with power supply input ends of modules that need to be powered in the polarization controller and the polarization switching apparatus, so as to supply a working power supply for the modules.

Further, the horn antenna body includes four ridges arranged circumferentially, a cavity is fixed at the lower end of each of the four ridges, and the cavity is configured to place electronic components.

Further, the horn antenna body includes four ridges arranged circumferentially, a cavity is fixed at the lower end of each of the four ridges, the cavity is configured to place electronic components, and the periphery of each of the four ridges is fixed with an antenna wall.

Further, a left-hand circular polarization component or a right-hand circular polarization component is generated by controlling a phase lead and lag relationship between a horizontal polarization component and a vertical polarization component.

Further, the horn antenna uses an aviation socket to input control signal.

Further, the polarization switching apparatus includes a multiport switch S1, a double-pole double-throw controllable switch S2, a single-pole double-throw controllable switch S3, a single-pole double-throw controllable switch S4 and a hybrid module, a common connection end of the multiport switch S1 is a signal input end and a signal output end of the horn antenna; four sub-connection ends of the multiport switch S1 are respectively connected with a sub-connection end of the single-pole double-throw controllable switch S3, a sub-connection end of the single-pole double-throw controllable switch S4, and two connection ends on the same side of the hybrid module; two connection ends of the other side of the hybrid module are connected with two sub-connection ends on the same side of the double-pole double-throw controllable switch S2; two sub-connection ends on the other side of the double-pole double-throw controllable switch S2 are respectively connected with the other sub-connection end of the controllable switch S3 and the other sub-connection end of the controllable switch S4; a main connection end of the controllable switch S3 and a main connection end of the controllable switch S4 are respectively connected with two signal connection ends of the horn antenna body; and a control output end of the polarization controller is connected with control ends of the multiport switch S1, the double-pole double-throw controllable switch S2, the single-pole double-throw controllable switch S3 and the single-pole double-throw controllable switch S4, which are configured to act under control of the polarization controller.

The beneficial effects produced by using the foregoing technical solutions are as follows: 1) the antenna has wide bandwidth, and can work effectively in microwave millimeter-wave frequency band; 2) the antenna can support four polarization modes: vertical polarization, horizontal polarization, left-hand circular polarization, and right-hand circular polarization; 3) the antenna can realize a quick switch among different polarization modes, and the switch is electrically controlled rather than performed by manually replacing the antenna; 4) the antenna can withstand high power and is light in weight; and 5) the antenna has simple machining process and has high reliability. In conclusion, using the present antenna can effectively shorten test time, reduce the number of times replacing antennas by a tester, and more accurately measure characteristics of a component under test in various polarization modes.

BRIEF DESCRIPTION OF THE DRAWINGS

The present invent is further described in details below with reference to the accompanying drawings and embodiments.

DETAILED DESCRIPTION OF THE EMBODIMENTS

Hereinafter, the technical solutions of the embodiment of the present invent will be described in a clearly and fully understandable way in connection with the drawings related to the embodiments of the present invent. It is obvious that the described embodiments are just a part but not all of the embodiments of the present invent. Based on the described embodiments of the present invent herein, other embodiments obtained by those skilled in the art without any inventive work should fall in the protection scope of the present invent.

Many specific details are described in the following description to facilitate a full understanding of the present invent. However, the present invent can be implemented in other manners, different from those described herein, and those skilled in the art can make similar variations without departing from the scope of the present invent. Therefore, the present invent is not limited by the specific embodiments disclosed herein below.

Figure 1:
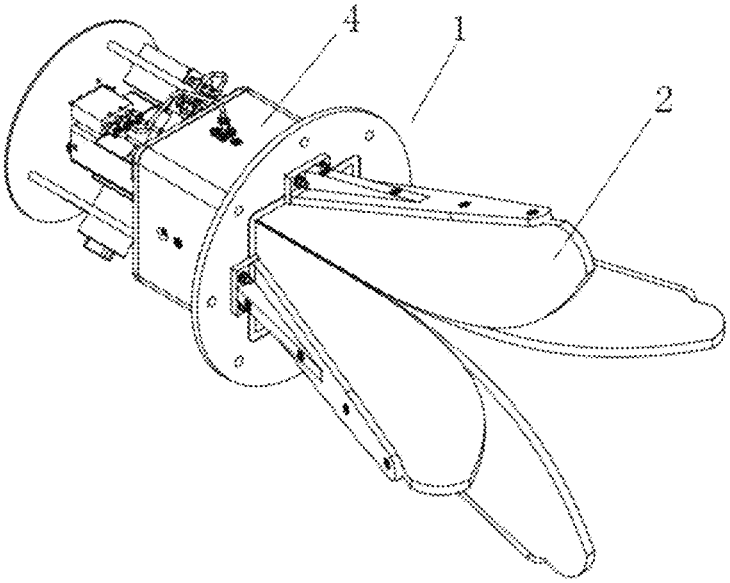
FIG. 1 is schematic diagram of a first structure of a horn antenna according to an embodiment of the present invent.
Figure 2:
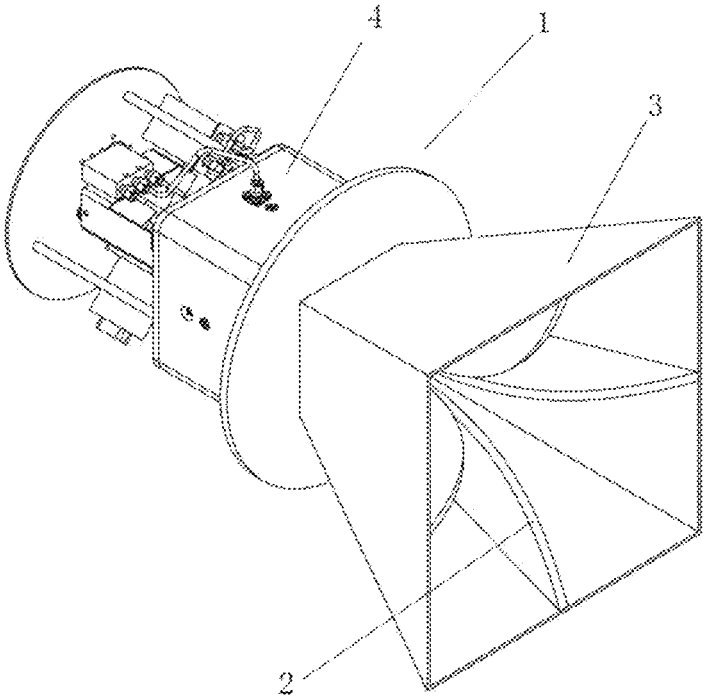
FIG. 2 is schematic diagram of a second structure of a horn antenna according to an embodiment of the present invent.
Figure 3:
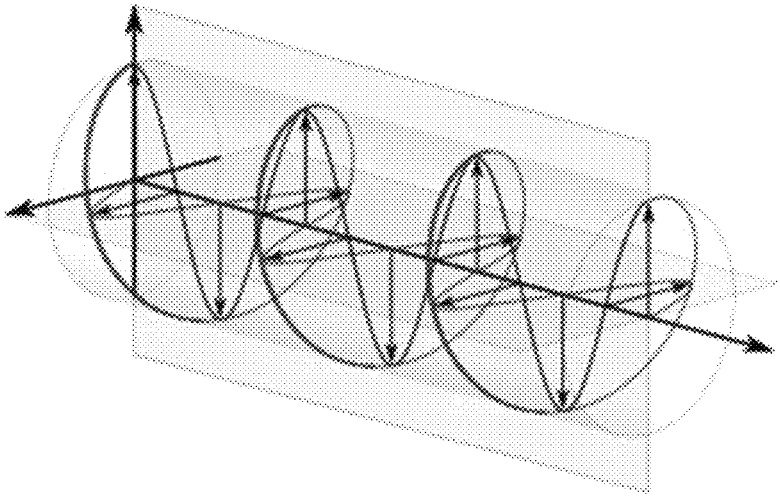
FIG. 3 is a schematic diagram of a right-hand circular polarization signal according to an embodiment of the present invent.
Figure 4:
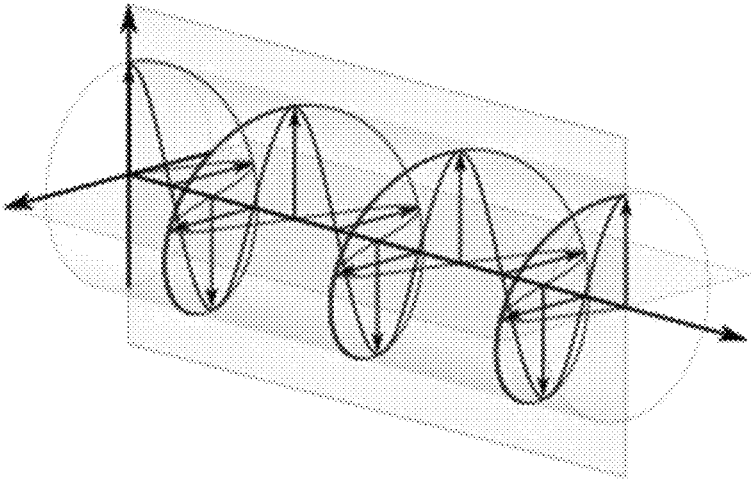
FIG. 4 is a schematic diagram of a left-hand circular polarization signal according to an embodiment of the present invent.
Figure 5:
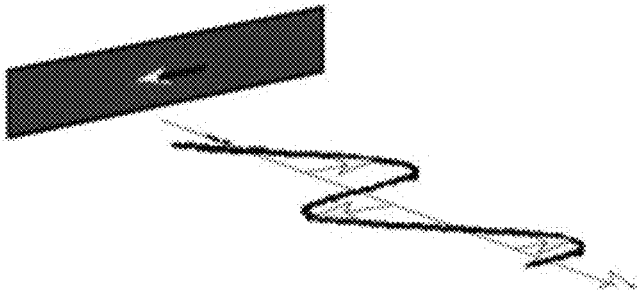
FIG. 5 is a schematic diagram of a horizontal polarization signal according to an embodiment of the present invent.
Figure 6:
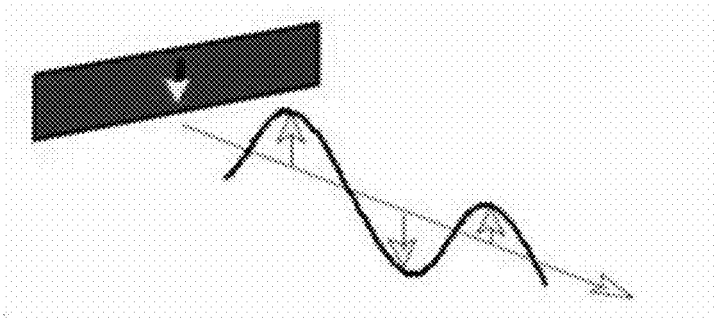
FIG. 6 is a schematic diagram of a vertical polarization signal according to an embodiment of the present invent.

As shown in FIG. 1, an electronically controlled switching multi-polarization horn antenna is disclosed, including a horn antenna body 1, wherein the horn antenna body 1 includes four ridges 2 arranged circumferentially, a cavity 4 is fixed at the lower end of each of the four ridges, and the cavity 4 is configured to place electronic components. As shown in FIG. 2, another electronically controlled switching multi-polarization horn antenna is disclosed, wherein the horn antenna body 1 includes four ridges 2 arranged circumferentially, a cavity 4 is fixed at the lower end of each of the four ridges, the cavity 4 is configured to place electronic components, and the periphery of each of the four ridges is fixed with an antenna wall 3. It should be noted that there are a plurality of specific forms of horn antenna, which will not be repeated here.

Figure 7:
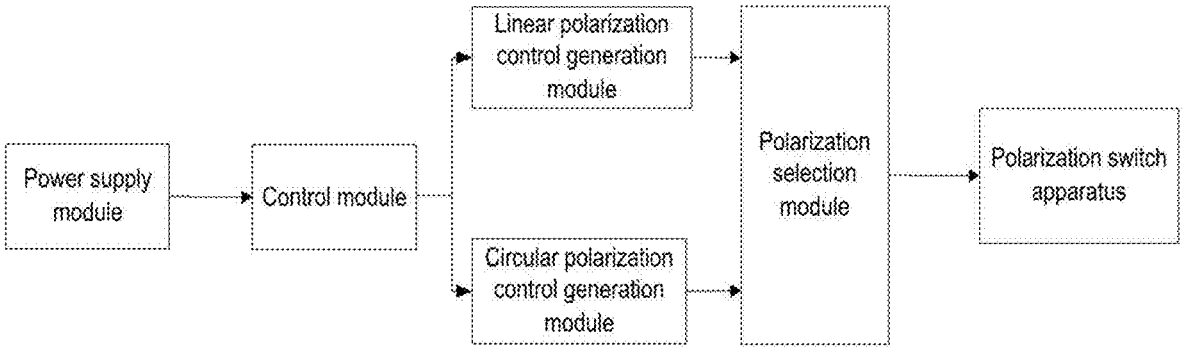
FIG. 7 is a functional block diagram of a polarization controller according to an embodiment of the present invent.

The present invent differs from the prior art in that the horn antenna further includes a horn antenna body, a polarization controller and a polarization switching apparatus, as shown in FIG. 7, the polarization controller includes a linear polarization control generation module and a circular polarization control generation module, a signal output end of the horn antenna's control module is respectively connected with signal input ends of the linear polarization control generation module and the circular polarization control generation module, the linear polarization control generation module is used to generate a horizontal or vertical polarization control signal under control of the control module, and the circular polarization control generation module is used to generate a left-hand circular polarization or a right-hand circular polarization control signal under the control of the control module; the output ends of the linear polarization control generation module and the circular polarization control generation module are connected with an input end of a polarization selection module, an output end of the polarization selection module is connected with a control input end of the polarization switching apparatus on the horn antenna body, the polarization selection module is used to select one of a horizontal polarization control signal, a vertical polarization control signal, a left-hand circular polarization control signal and a right-hand circular polarization control signal under the control of the control module and output the selected signal to the polarization switching apparatus; the polarization switching apparatus is configured to operate under the control of the control module and convert the received or transmitted signal, so as to make the horn antenna work in a horizontal polarization mode, a vertical polarization mode, a left-hand circular polarization mode or a right-hand circular polarization mode; a power supply module is connected with power supply input ends of modules that need to be powered in the polarization controller and the polarization switching apparatus, so as to supply a working power supply for the modules that need to be powered in the polarization controller and the polarization switching apparatus.

Optionally, the horn antenna uses an aviation socket to input control signal.

Figure 8:
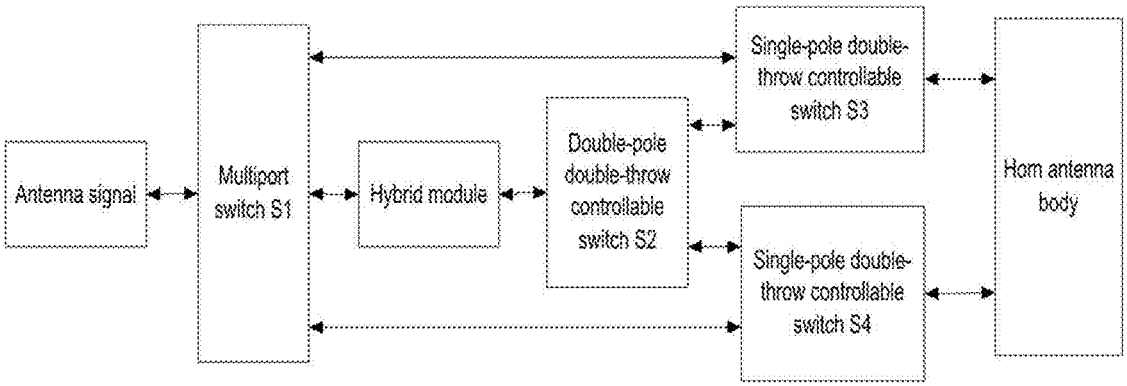
FIG. 8 is a functional block diagram of a polarization switching apparatus according to an embodiment of the present invent, wherein: reference sign 1 is horn antenna body; reference sign 2 is ridge; reference sign 3 is antenna wall; reference sign 4 is cavity.

As shown in FIG. 8, the polarization switching apparatus includes a multiport switch S1, a double-pole double-throw controllable switch S2, a single-pole double-throw controllable switch S3, a single-pole double-throw controllable switch S4 and a hybrid module; a common connection end of the multiport switch S1 is a signal input end and a signal output end of the horn antenna; four sub-connection ends of the multiport switch S1 are respectively connected with a sub-connection end of the single-pole double-throw controllable switch S3, a sub-connection end of the single-pole double-throw controllable switch S4, and two connection ends on the same side of the hybrid module; two connection ends of the other side of the hybrid module are connected with two sub-connection ends on the same side of the double-pole double-throw controllable switch S2; two sub-connection ends on the other side of the double-pole double-throw controllable switch S2 are respectively connected with the other sub-connection end of the controllable switch S3 and the other sub-connection end of the controllable switch S4; a main connection end of the controllable switch S3 and a main connection end of the controllable switch S4 are respectively connected with two signal connection ends of the horn antenna body; and a control output end of the polarization controller is connected with control ends of the multiport switch S1, the double-pole double-throw controllable switch S2, the single-pole double-throw controllable switch S3 and the single-pole double-throw controllable switch S4, which are configured to act under control of the polarization controller. In the present invent, the antenna is configured to use a polarization controller to control a controllable switch in the polarization switching apparatus for switching, so as to change the manner of an input signal and an output signal, thereby implementing switching between different polarization signals.

The antenna proposed in the present invent is an electrically-controlled multi-polarization broadband antenna. A single antenna can realize electrical switching of four polarization modes (vertical polarization, horizontal polarization, left-hand circular polarization and right-hand circular polarization) of a microwave millimeter-wave frequency band, and the switching speed is extremely fast. For example, take an antenna operating from 0.7 GHz to 10 GHz for detailed explanation. The antenna control adopts TTL (Transistor-Transistor Logic) level control, which stipulates that an output high level is greater than 2.4 V and an output low level is less than 0.4 V. The TTL level is standard technology for communication between a controller and various external devices, and facilitates connection with various controllers. The antenna is suitable for a laboratory test environment, and is used for transmitting or receiving an electromagnetic wave signal. The features of bandwidth, multi-polarization and fast switching of the antenna can effectively shorten test time, reduce the number of times replacing antennas by a tester, and more accurately measure characteristics of a device under test in various polarization modes. Specific parameters thereof are shown in Table 1.

TABLE 1

Antenna parameter table

| Polarization mode | Switchable between horizontal polarization, vertical polarization, left-hand circular polarization and right-hand circular polarization |
|---|---|
| Frequency (GHz) | 0.7-10.0 |
| Gain | Linear polarization: 2-14 dB typical value<br>Circular Polarization: 2-14 dBic typical value |
| Axial ratio (Bb) | 4.0 typical value<br>10.0 maximum value |
| Standing wave | 2.5 typical value |
| Connector | SMA-50k |
| Power handing peak | 20 W CW (cold switching) |
| Control power supply | 12 V DC |
| Control mode | TTL |
| Control connector | Aviation socket having 10 pins |
| Size (mm) | 310*310*535 |
| Net weight (Kg) | About 5.85 |

The antenna may implement switching of four types of polarization by the attached polarization controller. Polarization modes of an antenna are classified into two types: circular polarization and linear polarization, wherein the circular polarization may further be classified into left-hand circular polarization and right-hand circular polarization, and the linear polarization may be classified into vertical polarization and horizontal polarization by taking a ground as a reference. An electromagnetic wave of which the orientation of the electric field vector in space is fixed is called as linear polarization, when the angle between a polarization plane of an electromagnetic wave and a large ground normal plane changes periodically from 0 degree to 360 degrees, that is, the magnitude of the electric field is constant and the direction changes over time, and when the projection, on a plane perpendicular to a propagation direction, of the trajectory of the tail end of the electric field vector is a circle, it is referred to as circular polarization. The antenna can implement all of the four polarization modes.

Four Polarizations Modes:

1. Vertical polarization (V): the electric field direction being perpendicular to the ground
2. Horizontal polarization (H): the electric field direction being horizontal to the ground
3. Left-hand circular polarization (L): the electric field rotating with time and having a left helical relation to the direction of propagation of the electromagnetic wave
4. Right-hand circular polarization (R): the electric field rotating with time and having a right helical relation to the direction of propagation of the electromagnetic wave The principle of combining two linear polarizations into a circular polarization is as follows:

$$\Sigma_v = E_m \sin \omega t$$

(vertical polarization component)

$$E_h = E_m \cos \omega t$$

(Horizontal Polarization Component)

A circular polarization wave is formed after the two components are spatially combined, and left-hand circular polarization or right-hand circular polarization can be realized by controlling the phase lead and lag relationship between the two components. For a specific polarization mode, reference may be made to FIG. 3 to FIG. 6. The antenna works in different polarization modes by electrical signals. The antenna has two external interfaces, one is a Y2M(YP21) aviation socket for inputting power and control signals, the other one is a radio-frequency connector with an SMA contact for inputting and outputting radio frequency signals, and the function definition of the aviation socket pins is as shown in Table 2 as follows.

TABLE 2

Pin Functionality Definitions

| Pin number | Name | Description |
|---|---|---|
| 1 | NC | |
| 2 | +12 V | +12 V DC voltage input |
| 3 | GND | Ground |
| 4 | V | Polarization control: vertical polarization |
| 5 | H | Polarization control: horizontal polarization |
| 6 | C/L | Polarization control: circular polarization/linear polarization |
| 7 | R | Polarization control: right-hand circular polarization |
| 8 | L | Polarization control: left-hand circular polarization |
| 9 | NC | |
| 10 | NC | |

The antenna polarization mode is controlled by five TTL level control pins which are respectively V, H, C/L, R and L, wherein the C/L pin selects whether the antenna works in a circular polarization mode or a linear polarization mode; when the C/L is at a high level, the antenna works in the circular polarization mode; and when the C/L is at a low level, the antenna works in the linear polarization mode. Different polarization modes may be used as long as the control pin is operated according to Table 3. When polarization switching is performed, the radio frequency power cannot be higher than 2 W, and the radio frequency power does not exceed 20 W after the switching is completed. The voltage range of the logic level 1 is 2.5-5V, and the voltage range of the logic level 0 is 0-0.8V,

TABLE 3

Polarization mode control table

| Polarization | Pin 4(V) | 5(H) | 6(C/L) | 7(L) | 8(L) |
|---|---|---|---|---|---|
| Vertical polarization | 1 | 0 | 0 | 0 | 0 |
| Horizontal polarization | 0 | 1 | 0 | 0 | 0 |
| Right-hand circular polarization | 0 | 0 | 1 | 1 | 0 |
| Left-hand circular polarization | 0 | 0 | 1 | 0 | 1 |

(1) An antenna has a wide bandwidth, and can work effectively in a microwave millimeter-wave frequency band.
(2) The antenna can support four polarization modes: vertical polarization, horizontal polarization, left-hand circular polarization, or right-hand circular polarization.
(3) The antenna can realize a quick switch between different polarization modes, and the switch is electrically controlled rather than performed by manually replacing the antenna.
(4) The antenna can withstand high power, about 20 W, and light in weight, less than 6 kg.
(5) The antenna has simple machining process and has high reliability.

Using the antenna of the present invention can effectively shorten test time, reduce the number of times replacing antennas by a tester, and more accurately measure characteristics of a device under test in various polarization modes.

What claimed is:

1. An electrically-controlled switching multi-polarization horn antenna, including a horn antenna body (1), a polarization controller and a polarization switching apparatus, wherein the polarization controller includes a linear polarization control generation module and a circular polarization control generation module, a signal output end of the horn antenna's control module is respectively connected with signal input ends of the linear polarization control generation module and the circular polarization control generation module, the linear polarization control generation module is used to generate a horizontal or vertical polarization control signal under control of the control module, and the circular polarization control generation module is used to generate a left-hand circular polarization or a right-hand circular polarization control signal under the control of the control module; the output ends of the linear polarization control generation module and the circular polarization control generation module are connected with an input end of a polarization selection module, an output end of the polarization selection module is connected with a control input end of the polarization switching apparatus on the horn antenna body, the polarization selection module is used to select one of a horizontal polarization control signal, a vertical polarization control signal, a left-hand circular polarization control signal and a right-hand circular polarization control signal under the control of the control module and output the selected signal to the polarization switching apparatus; the polarization switching apparatus is configured to operate under the control of the control module and convert the received or transmitted signal, so as to make the horn antenna work in a horizontal polarization mode, a vertical polarization mode, a left-hand circular polarization mode or a right-hand circular polarization mode; a power supply module is connected with power supply input ends of modules that need to be powered in the polarization controller and the polarization switching apparatus, so as to supply a working power supply for the modules that need to be powered in the polarization controller and the polarization switching apparatus.

2. The electrically-controlled switching multi-polarization horn antenna as claimed in claim 1, wherein the horn antenna body (1) includes four ridges (2) arranged circumferentially, a cavity (4) is fixed at the lower end of each of the four ridges, and the cavity (4) is configured to place electronic components.

3. The electrically-controlled switching multi-polarization horn antenna as claimed in claim 1, wherein the horn antenna body (1) includes four ridges (2) arranged circumferentially, a cavity (4) is fixed at the lower end of each of the four ridges, the cavity (4) is configured to place electronic components, and the periphery of each of the four ridges is fixed with an antenna wall (3).

4. The electrically-controlled switching multi-polarization horn antenna as claimed in claim 1, wherein a left-hand circular polarization component or a right-hand circular polarization component is generated by controlling a phase lead and lag relationship between a horizontal polarization component and a vertical polarization component.

5. The electrically-controlled switching multi-polarization horn antenna as claimed in claim 1, wherein the polarization switching apparatus includes a multiport switch S1, a double-pole double-throw controllable switch S2, a single-pole double-throw controllable switch S3, a single-pole double-throw controllable switch S4 and a hybrid module; a common connection end of the multiport switch S1 is a signal input end and a signal output end of the horn antenna; four sub-connection ends of the multiport switch S1 are respectively connected with a sub-connection end of the single-pole double-throw controllable switch S3, a sub-connection end of the single-pole double-throw controllable switch S4, and two connection ends on the same side of the hybrid module; two connection ends of the other side of the hybrid module are connected with two sub-connection ends on the same side of the double-pole double-throw controllable switch S2; two sub-connection ends on the other side of the double-pole double-throw controllable switch S2 are respectively connected with the other sub-connection end of the controllable switch S3 and the other sub-connection end of the controllable switch S4; a main connection end of the controllable switch S3 and a main connection end of the controllable switch S4 are respectively connected with two signal connection ends of the horn antenna body (1); and a control output end of the polarization controller is connected with control ends of the multiport switch S1, the double-pole double-throw controllable switch S2, the single-pole double-throw controllable switch S3 and the single-pole double-throw controllable switch S4, which are configured to act under control of the polarization controller.

6. The electrically-controlled switching multi-polarization horn antenna as claimed in claim 1, wherein the horn antenna uses an aviation socket to input control signal.

* * * * *